US007819388B2

(12) United States Patent
McCallion

(10) Patent No.: US 7,819,388 B2
(45) Date of Patent: Oct. 26, 2010

(54) TENDON GRIPPING DEVICE

(76) Inventor: James P. McCallion, c/o RJD Industries, Inc., 26945 Cabot Rd., Suite 105, Laguna Hills, CA (US) 92653-7009

( * ) Notice: Subject to any disclaimer, the term of this patent is extended or adjusted under 35 U.S.C. 154(b) by 617 days.

(21) Appl. No.: 11/333,553

(22) Filed: Jan. 17, 2006

(65) Prior Publication Data

US 2007/0175128 A1 Aug. 2, 2007

(51) Int. Cl.
*E04G 21/12* (2006.01)

(52) U.S. Cl. ..... 254/29 A; 249/40; 24/136 B; 52/223.13; 254/134.3 FT; 29/253; 29/270; 29/278; 269/3; 269/6; 269/229

(58) Field of Classification Search ..... 52/223.13, 52/223.14; 24/136 R, 136 B, 115 M; 249/219.1, 249/219.2, 38, 36, 40, 43; 425/111; 254/29 A, 254/134.3 FT; 403/45, 48; 294/102.1; 29/253, 29/270, 278; 269/3, 6, 229
See application file for complete search history.

(56) References Cited

U.S. PATENT DOCUMENTS 1,258,580 A * 3/1918 Lassiter ..... 403/374.4
1,634,422 A 11/1926 Holmes
2,075,239 A 3/1936 Strange
2,171,120 A 5/1938 Bullard
2,177,364 A * 10/1939 Fotsch ..... 403/185
2,657,933 A * 11/1953 Stuebner ..... 279/28
2,699,589 A * 1/1955 Redell ..... 294/102.1
2,896,496 A * 7/1959 Jansen ..... 411/347
2,935,299 A * 5/1960 Jansen ..... 254/29 A
3,117,485 A * 1/1964 Jansen ..... 411/427
3,163,904 A * 1/1965 Ziolkowski ..... 403/365
3,361,460 A * 1/1968 Jansen ..... 403/16
3,374,511 A * 3/1968 Barker ..... 403/369
3,478,396 A * 11/1969 Drouillard ..... 403/371
3,910,546 A 10/1975 Connors
3,912,406 A * 10/1975 McGrath ..... 403/19
3,956,797 A * 5/1976 Brandestini et al. ..... 52/223.13
3,965,542 A 6/1976 Gregory
4,192,215 A * 3/1980 Hymans ..... 411/548
4,192,481 A 3/1980 Durbin
4,307,550 A * 12/1981 Behar ..... 52/223.13
4,363,462 A * 12/1982 Wlodkowski et al. ..... 249/190

(Continued)

OTHER PUBLICATIONS

"Standard Test Method for Tensile Properties of Pultruded Glass-Fiber-Reinforced Platsic Rod," ASTM Designation: D 3916-84 (Reapproved 1988), pp. 555-558.

*Primary Examiner*—Robert J Canfield
*Assistant Examiner*—Jessie Fonseca
(74) *Attorney, Agent, or Firm*—Myers Andras Sherman LLP; Joseph C. Andras

(57) ABSTRACT

An apparatus for gripping smooth and/or deformed cylindrical or multiple stranded tendons (rods) commonly used in the Art of Construction, the apparatus comprising a housing (barrel), a plurality of jaws (wedges) within the housing, a tightening device to align the jaws (wedges) and to cause engagement of the jaws (wedges) to the tendon (rod), a tensioning device to properly position the apparatus. The tendon (rod) gripping apparatus includes a first aperture and a second aperture that facilitate passage of a tendon (rod) through the apparatus. The jaw (wedge) cluster comprises a plurality of elongated members, that surround the tendon (rod), are generally wedge shaped and complementary to an inner tapered wall of the housing (barrel).

13 Claims, 6 Drawing Sheets

U.S. PATENT DOCUMENTS 5,018,251 A * 5/1991 Brown ..... 24/122.6
5,154,558 A 10/1992 McCallion
5,594,201 A * 1/1997 Reinert, Sr. ..... 174/37
5,594,977 A * 1/1997 McCallion ..... 24/136 B
5,755,065 A * 5/1998 Sorkin ..... 52/223.13
5,791,816 A 8/1998 McCallion
6,092,960 A 7/2000 McCallion
6,265,065 B1 7/2001 McCallion
6,470,636 B1 * 10/2002 Rose ..... 52/223.1
6,565,288 B1 5/2003 McCallion
2002/0001504 A1 * 1/2002 McCallion ..... 403/374.3

* cited by examiner

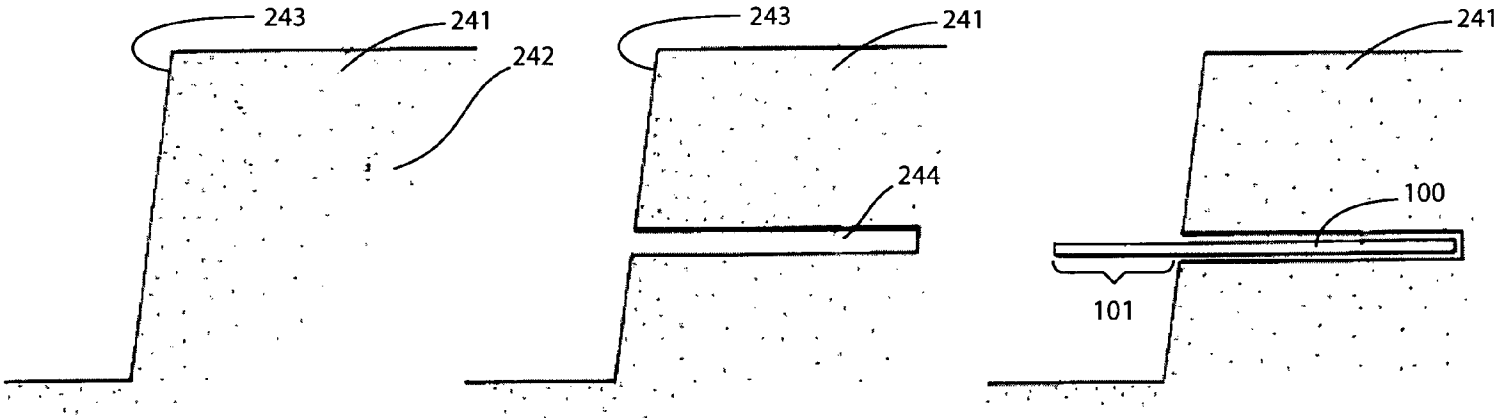
FIG. 11A
FIG. 11B
FIG. 11C
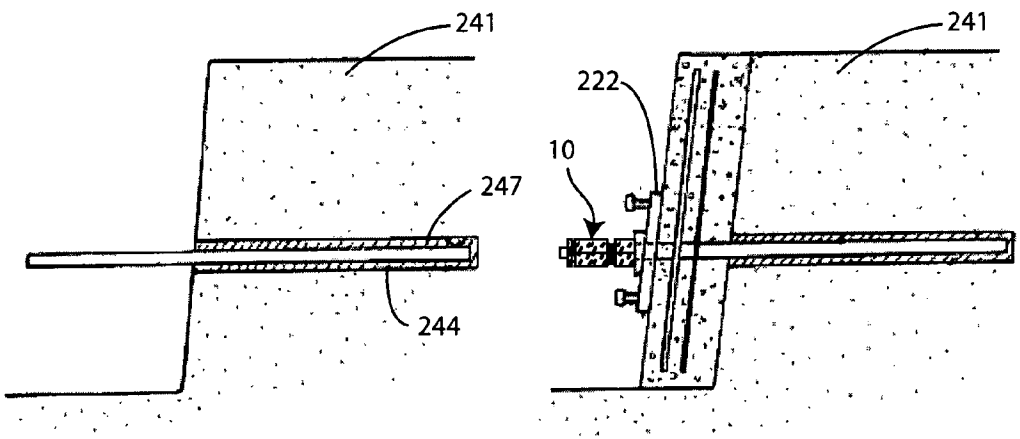
FIG. 11D
FIG. 11E
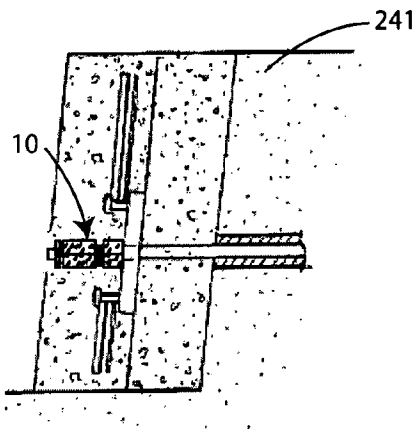
FIG. 11F

TENDON GRIPPING DEVICE

BACKGROUND OF THE INVENTION

1. Field of the Invention

The present invention relates to a tendon (rod) gripping apparatus primarily for gripping smooth and/or deformed or multiple stranded tendons (rods), and more particularly, to an apparatus including a housing (barrel) for receiving a tendon (rod), a plurality of elongated jaw (wedge) members, a partially externally threaded cylindrical tube device to tighten and align the jaws (wedges) and to cause initial engagement of the jaws (wedges) to the tendon (rod) by wedging the jaws (wedges) within the housing (barrel) between the tendon (rod) and inner wall of the housing (barrel), a partially internally threaded tensioning device to properly position the apparatus.

As used herein, the term tendon is interchangeable with the term rod. Tendons (rods) are primarily a tensile unit when used in the Art of Construction, meaning that forces are induced normal to the longitudinal axis of the tendon (rod).

Tendons (rods) are utilized in the Art of Construction, in particular concrete construction in order to add to the strength of structures as is the case with concrete reinforcement (rebar and pre & post tensioning devices), and as is the case with soil or rock embankment stabilization devices (soil nails, rock anchors) to name a few that are most common.

Tendons are commonly used in a temporary load bearing but non-structural capacity (that which does not add strength to the completed structure). In one such instance, tendons are known to the art as formties. In vertical concrete construction, a cementitious material is placed between erected walls, termed formwork, which provide support until the concrete curing, hardening process is completed. Tremendous force is often exerted upon the formwork, particularly when large volumes of concrete are placed. Tie-rods, termed formties, are passed through holes drilled in the forms to prevent an outward expansion of the erected forms during placement and initial hydration, set, of concrete walls.

The formwork typically includes beams and planks or the like ("wales", and "stiffbacks", as known in the construction art). A tendon-gripping apparatus is used to prevent the formwork from sliding along the form tie. The formwork, in turn, serves as a guide for the formtie and as a platform against which the tendon-gripping apparatus is positioned. The force-distributing construction of the formwork supports the erected walls and prevents outward bulging of the walls while the fluid concrete is hardening.

Although concrete construction techniques have progressed tremendously over the last 50 years, most formties have not changed. The use of steel formties is particularly problematic because of the need to avoid rust which can destroy a structure or ruin its appearance. Prior attempts to eliminate structural rusting include either entirely removing the steel tendon or breaking the tendon back to a distance below the surface. The resultant hole is then plugged and patched over with cementitious material. These practices are very labor intensive and expensive. Unfortunately, the patching often results in an unprofessional finish, or worse, is overlooked, or simply fails to prevent rusting from occurring.

The use of deformed or multiple stranded tendons in the mode of concrete reinforcement (rebar) is within the field of knowledge of most laymen even though not intimately involved with the Art of Construction. In some cases this type of tendon is used as a formtie, as noted above, or in embankment stabilization, as noted below.

Soil or rock embankment stabilization is a particular construction art whereby an unstable elevation such as a hill, mountain, or cliff, having a substantially vertical face that is prone to catastrophic landslides is stabilized and rendered safe. External stabilization may be accomplished in a number of ways; by using netting made of various materials or stacking rock filled mesh baskets, know as gabions, at the face of the embankment to restrain the embankment. Internal stabilization is accomplished by drilling a hole in the embankment to a pre-determined depth and inserting a tendon of a pre-determined diameter somewhat less than that of the hole, to approximately the hole depth, and filling the annular space between the tendon and the pre-drilled hole with a cementitious mixture creating a bond between the tendon and the embankment. The tendon may be smooth, threaded or deformed such as re-bar or multiple stranded tendons and is secured to a retaining wall structure built at the face of the embankment that is either of concrete or steel. Threaded tendons may be secured via threaded apparatus such as common threaded nuts. Smooth or deformed cylindrical tendons, or multiple stranded tendons, may be secured via a device such as the instant invention.

The internal embankment forces that lead to embankment failure are transferred to the tendon and from the tendon to the retaining wall structure. The retaining wall structure captures any slough from the face of the embankment. In the case of a concrete retaining wall structure, formwork is constructed as noted above.

The tendon gripping apparatus disclosed herein is beneficially capable of gripping smooth and/or deformed, or multiple stranded fiberglass tendons (rods), thereby eliminating the problem of structural failure due to steel tendon corrosion. Furthermore, the tendon gripping apparatus, which includes a unique jaw assembly or jaw cluster, a means to set and align the jaws, and a tension device to properly place the apparatus against the formwork or embankment retaining.

The ultimate, failure strength of various tendons (rods) is established through very detailed laboratory test involving gripping devices that cannot be practically, or cost effectively used in construction applications. Testing, and reporting of test results are governed by such nationally recognized agencies as ASTM (American Society for Testing Materials). As an example, appended to this document is a copy of ASTM D3916 "Standard Test Method for Tensile Properties of Pultruded Glass-Fiber-Reinforced Plastic Rod". For tensile testing, the "Tab Grip Adapters", (FIG. 1, page 556) are constructed so as tendon (rod) failure does not occur at the grips as a result of the gripping action, but at the tendon in the area away from the grips. The area of contact between the grips and the tendon is of such a value as to allow transfer of the full ultimate load to the tendon uniformly. This action gives the true ultimate tensile strength of the tendon (rod) itself. The Universal Testing Machine, noted in the ASTM document generates the tensile force. The testing grips cannot practically operate independently of Universal Testing Machine. As a concurrence to the test results, the ultimate tensile strength may be calculated using tendon material component strengths. Tests, like that lastly noted are to verify that manufacturing processes produce materials to known values.

For practical applications, such as those aforementioned in construction, the gripping apparatus must be of a manageable size, have a method to assure the jaws (wedges) are set on to and engage the tendon, have a method to properly position the apparatus, and be re-useable many times without detailed maintenance, and in addition the apparatus must have the capability to be applied swiftly. As an example of manageable size, to use the testing grips in such applications already noted, for a 0.500" diameter tendon (see ASTM D3916, "TABLE 1") the device would be at a minimum of 24 inches long. For the same diameter tendon (rod) the instant apparatus is 2.50 inches long while still incorporating the features as presented. The sacrifice to meet these parameters is that the tensile strength of the tendon is limited to the relative action of the gripping apparatus components, primarily the action of the jaws (wedges). Unlike that used in laboratory the configuration of current tendon gripping devices limits this ultimate tendon tensile strength at failure is attributable to the nose of the jaws (wedges) biting into the tendon with continuing vigor until tendon (rod) tensile occurs. This is especially true when tendons comprised of fiberglass materials are used. The instant apparatus better transfers load to the tendon via unique interaction of the jaws (wedges) to the barrel and by the unique action of the jaws (wedges) to tendon (rod) engagement.

There are a number of parameters that govern load transfer from the jaws to the tendon. As illustrated through the ASTM testing procedure above the length, and subsequent area of engagement can be the main governing parameter. As noted for practical applications length and thus overall size of the apparatus is a strong consideration. As noted for the preferred embodiment the action of the jaws biting into the tendon limits the load capacity of the apparatus and tendon. The current invention incorporates novel methods to increase this load capacity while maintaining a manageable apparatus size. Firstly, the angle of incidence, or incident angle, between the tapered jaws and the internally tapered housing (barrel) is such that the under loading the rear portion, the large, butt end of the jaws are forced to more engage the tendon prior to the nose biting into the tendon. Secondly the instant apparatus incorporates a relieved, un-threaded portion at the internally threaded nose of the jaws. This last innovation, combined with the incident angle, greatly enhance the load bearing performance of the apparatus at a reduced length and thus tendon jaw contact area. These novel innovations will become apparent as this application continues.

Mentioned above is swift application of the apparatus. In addition to the necessity for swift application, the necessity for this method of application to be sturdy is paramount in the construction art to which it is envisioned that the device will be used primarily. Swift application for the instant is accomplished via the use of a speed thread having less threads per unit length (TPI—Threads Per Inch) then would a common machine nut. Standards for a common machine one inch diameter nut are 8-14 TPI. For the instant device with one inch threaded components the threads are at 5 TPI. With fewer TPI there is more threaded material available for load bearing and preclude possible damage. These innovations will become apparent as this application continues.

2. Discussion of Related Art

The art of tendon gripping devices is generally cognizant of gripping devices specifically designed for use with threaded tendons. Camming mechanisms used to secure tendon within a gripping device are also known. Representative prior art in the field of tendon gripping devices is shown below.

U.S. Pat. No. 5,154,558 discloses a smooth rod gripping device used in a blind anchoring situation.

U.S. Pat. No. 5,594,977 teaches the use of a smooth rod gripping device whereby the jaws are captured.

U.S. Pat. No. 4,192,481 discloses grippers that are specifically designed for use with threaded rod, and not a smooth rod. U.S. Pat. No. 2,614,801 discloses a wire holding and pre-stressing device.

U.S. Pat. No. 3,910,546 teaches a she-bolt type gripper device for a concrete wall formed tie rod. U.S. Pat. No. 3,965,542 is similar to preceding reference, and further adds a latch mechanism.

U.S. Pat. No. 1,634,422 discloses a rod clamp which operates by camming the tabs of opposing grip members within spiraled slots.

U.S. Pat. Nos. 2,075,239 and 2,171,120 both teach variations of a tie mechanism

U.S. Pat. No. 2,699,589 discloses a smooth rod clamping device. U.S. Pat. Nos. 2,896,496 and 3,117,485 teach the use of a spring within a shaft clamping mechanism. U.S. Pat. Nos. 4,192,215, 4,363,462 and 6,565,288 are additionally cited as of interest.

The need for an improved smooth and deformed or multiple stranded tendons still exists.

In the case of concrete formwork, including the use of multiple stranded tendons used as formties, including formwork used to construction the soil or rock embankment stabilization retaining wall structure, two opposing are erected to form a channel into which concrete is placed, they must be held together until the concrete sets. A smooth, or deformed, or multiple stranded tendon is passed through the formwork which is positioned on the outwardly facing surfaces of the structure to be constructed. The formwork, through which the tendon passes, serves as a base or platform for a tendon gripping device. A problem typical of smooth or deformed or multiple stranded tendons is that slippage occurs, allowing the walls to expand. Various presetting techniques, such as pounding a wedge shaped object between the gripping device and the formwork, have been utilized in attempts to minimize this slippage. The existence of springs in many gripping devices contributes to this slippage.

OBJECTS AND SUMMARY OF THE INVENTION

An object of the present invention is to provide a tendon gripping apparatus for gripping tendon, wherein the apparatus prevents formwork from sliding outwardly along the tendon.

Another object is to provide a gripping apparatus comprising very few mechanical parts, no springs, thereby eliminating the need to preset the gripping apparatus to minimize slippage.

An additional object is to provide a gripping apparatus which may be released and slip off the tendon, thereby making room for a grinding or cutting tool to cut the tendon from the hardened concrete wall.

Another object is to provide tendon gripping device which will allow positive spreading of formwork to desired finished structure by erecting both sides of the formwork, passing the tendon through the structure, installing the gripping apparatus over the tendon, engaging the tendon to the apparatus via a tightening nut.

In one embodiment, the invention resides in an apparatus for gripping tendons that comprises a housing (barrel), a plurality of elongated jaws (wedges), a tightening device to position and tighten, engage the jaws to the tendon, and a tensioning device to properly align the apparatus to the form and allow the apparatus tensioning device to place the formwork in the desired position, and provide a positive spreading device. A first aperture, located in the tensioning nut receives the tendon into a chamber within the housing (barrel), the tendon exiting though the second aperture located in the tightening nut. The housing (barrel) chamber is defined by a tapered inner wall that narrows toward the first aperture.

When the tendon traverses the housing (barrel), the plurality of elongated members which define a jaw assembly or jaw cluster, surround the tendon and are radially positioned between the tendon and the tapered wall of the chamber. The tightening nut pushes the jaw cluster toward the first aperture, thereby initiating a setting contact between the elongated jaw members and the tapered inner wall securing the tendon within the apparatus. The tensioning nut is manipulated against the formwork to set the desired wall thickness and to induce additional engagement of the jaw cluster. After the concrete has hardened, the device is removed from the formwork by either of two methods; (1) the tensioning nut is manipulated away from the formwork and in the space thus provided a grinder or saw is used to cut the tendon at the formwork outward surface, or (2) the tensioning nut is manipulated away from the formwork, the tightening nut loosened and the tightening nut is struck with a hammer like force toward the formwork into the space provided by the loosened tensioning nut, releasing the jaw cluster from the tendon. The apparatus may then be slipped outward and removed from the tendon. To release the tendon logged in the apparatus for method (1), the tightening nut is loosened and the same force noted in (2) is applied releasing the jaw cluster from the tendon.

These and other features and advantages of the invention will become more apparent with a description of preferred embodiments in reference to the associated drawings.

DESCRIPTION OF THE DRAWINGS

The objects and features of the present invention, which are believed to be novel, are set forth with particularity in the appended claims. The present invention, both as its organization and manner of operation, together with further objects and advantages, may be best understood by reference to the following description, taken in connection with the accompanying drawings.

FIG. 9A shows the preferred embodiment of FIG. 1 (a hexagonal geometry that permits standard wrenching tools known to the art to be used for installation, removal, and disassembly of the apparatus).

FIG. 9B shows a cylindrical embodiment;

FIG. 9C shows a cylindrical embodiment with knurled barrel;

FIGS. 11A to 11F are a series of illustrations showing how the tending gripping apparatus 10 may be used in connection with an embankment;

FIG. 11A is a side view of an embankment;

FIG. 11B is a side view of the embankment now having a hole formed therein;

FIG. 11C is a side view of a tendon inserted into the hole of the embankment;

FIG. 11D is a side view illustrating grout disposed in the hole of the embankment;

FIG. 11E is a side view illustrating a bearing plate and tendon gripping apparatus installed; and FIG. 11F is a side view illustrating embankment with tendon gripping apparatus in operative configuration.

DESCRIPTION OF THE PREFERRED EMBODIMENT

The following description is provided to enable any person skilled in the art to make and use the invention and sets forth the best mode contemplated by the inventor of carrying out his invention. Various modifications, however, will readily apparent to those skilled in the art, since the generic principle of the present invention have been defined herein specifically to provide a tendon gripping device.

Figure 1:
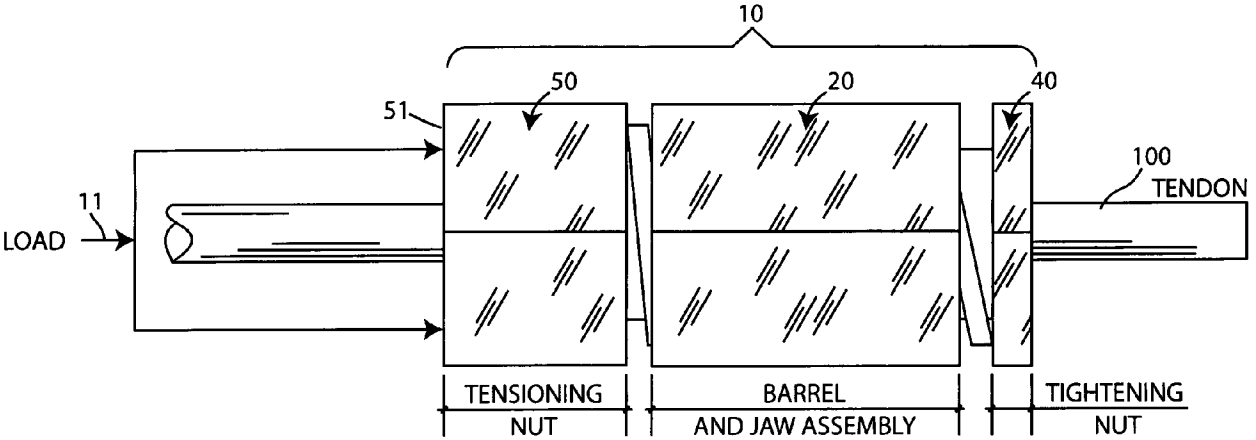
FIG. 1 is a side view of a preferred embodiment of a tendon gripping apparatus 10 as assembled on to a tendon 100.
Figure 2:
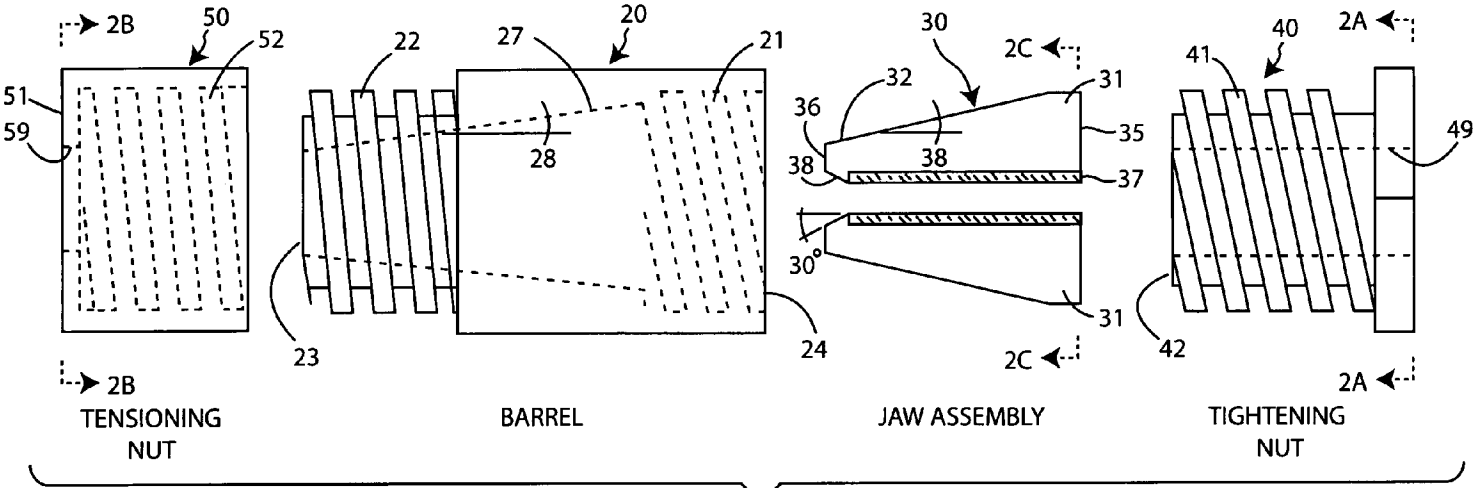
FIG. 2 is an exploded side view of the various disassembled components of the preferred tending gripping apparatus.
Figure 2A:
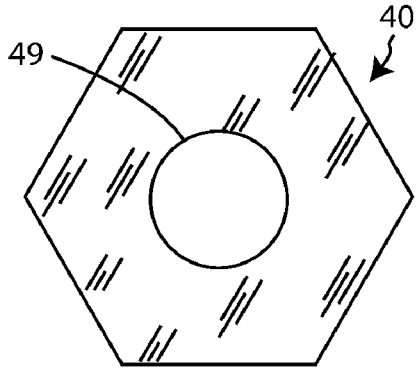
FIG. 2A is an end view of the tightening nut 40 of FIG. 2 as viewed along section lines 2A-2A.
Figure 2B:
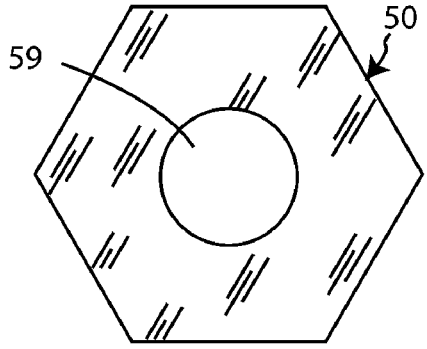
FIG. 2B is an end view of the tensioning nut 50 of FIG. 2 as viewed along section lines 2B-2B.

FIGS. 1 and 2 illustrate a preferred tendon gripping apparatus 10. First, for context, FIG. 1 shows a fully assembled tendon gripping apparatus 10 joined to a tendon 100. FIG. 2 is an exploded side view that shows that the preferred tendon gripping apparatus 10 comprises a housing or barrel 20, a wedge assembly 30 that fits within the barrel 20, a tightening nut 40, and a tensioning nut 50. As best shown in FIGS. 2A and 2B discussed below, the external configuration of the preferred gripping apparatus 10 is generally hexagonal in shape.

Returning to FIG. 1, one can see that apparatus loading 11 is transmitted evenly to an front planar abutment surface 51 of the tensioning nut 50 that serves as a surface for bearing against concrete framework (explained further herein), then to the barrel 20, then to the jaws 30 (not visible in FIG. 1, but see FIG. 2), and finally to the tendon 100 passing through the tendon gripping apparatus 10. This load transfer is discussed in further detail below in the discussion of FIGS. 10A to 10C.

Focusing on FIG. 2, one can appreciate the structure and interoperation of the components that make up the preferred tendon gripping apparatus 10, i.e. the barrel 20, the jaw assembly (jaw cluster) 30, the tightening nut 40, and the tensioning nut 50. As shown, the barrel 20 includes a conical taper or tapered inner wall 27 that defines a chamber for receiving the jaw assembly 30. The conical taper is accessible on opposing ends of the barrel 20 through a front aperture 23 and a rear aperture 24. The barrel also has an internally threaded section 21 formed from a helical groove on an interior of the barrel that surrounds the rear aperture 24 and rotatably engages an externally threaded section 41 formed from a helical groove carried circumferentially about an intermediate portion of the tightening nut 40 which, when so engaged, also has a pushing surface 42 that will contact a rear portion of the jaw assembly 30 and push the jaw assembly 30 into the barrel's conical taper 17. Lastly, the barrel 20 has an externally threaded section 22 formed from a helical groove on the exterior of the barrel that surrounds the front aperture 23 and rotatably engages an internally threaded section 52 of the tensioning nut 50 formed from a helical groove which, when rotated, changes the axial distance between its surface 51 and the barrel 20.

FIGS. 2A and 2B are end views of the tightening nut 40 and tensioning nut 50, respectively. FIGS. 2A and 2B clearly show that each nut includes a tendon aperture 49, 59 that leads to a cylindrical conduit (not separately numbered) through the respective nut 40, 50, and a mechanical interface for being torqued or twisted. The cylindrical conduit through each nut, of course, is larger than a diameter of the tendon 100. The preferred mechanical interface is an external geometry that is generally hexagonal.

Figure 2C:
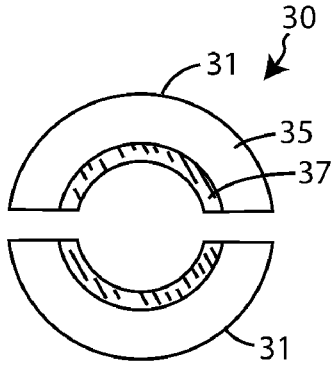
FIG. 2C is an end view of the jaw assembly or jaw cluster 30 of FIG. 2 as viewed along section lines 2C-2C.

FIGS. 2 and 2C illustrate the preferred jaw assembly 30, FIG. 2 being a side view thereof, and FIG. 2C being an end view thereof as viewed along lines 2C-2C. From these two figures, one can see that the preferred jaw assembly 30 is formed from two elongated jaw members or individual jaws 31, 31 that each include a tapered outer surface 32, a jaw butt or rear 35, a jaw nose or front 36, and a clasping inner surface comprising an internal thread 37 (i.e. bored and tapped) that engages the tendon 100. Also, for reasons defined further below, a jaw thread relief 38 is formed at the nose 36 of each jaw 31 such that, when the jaws 31, 31 are adjacent to one another to form the overall jaw assembly 30, an annular countersink is presented around an inner diameter of the jaw assembly 30. As discussed above in the "Field of the Invention", and as most clearly shown in FIG. 2, the barrel 20 has an incident angle 28.

Assembly of the tendon gripping apparatus 10 shown in FIG. 1 is accomplished by assembling the components shown in FIG. 2, as follows:

the jaw assembly 30 is inserted into the barrel 20, through the threaded chamber defined by the barrel's internal threads 21, into the taper 27 defined in the barrel 20.

the tightening nut 40 is loosely fitted to the barrel 20 and positioned adjacent to the jaw assembly 30 by engaging its external threads 41 to the barrel's internal threads 21 (in the preferred embodiment, "loosely", is a bit less than three turns from the fully-tightened position); and the tensioning nut 50 is loosely fitted on to the external threads 22 of the barrel 20.

In use, the fully assembled tendon gripping apparatus 10 is slid over the tendon 100 via the aperture 59 located in the tensioning nut 50, then into the barrel 20, then into and through the jaw assembly 30, and then out the aperture 49 located in the tightening nut 40.

Figure 3:
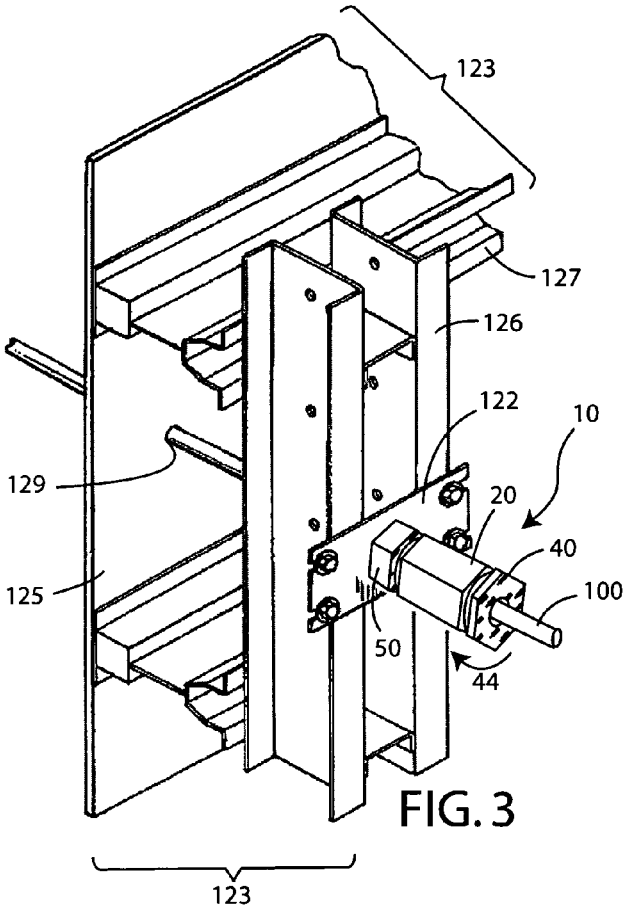
FIG. 3 is a perspective view of the preferred tendon gripping apparatus 10 secured to a tendon 100. The figure also shows formwork and a common bearing plate that incorporates a hole drilled in the center of the plate to accommodate passage of the tendon while functioning as a platform against which the tendon gripping apparatus is mounted. The common bearing plate is also a guide for the tendon as it passes through a wall. The tendon gripping apparatus abuts but is not attached to the common bearing plate. The common bearing plate may be attached to the formwork as shown, or it may be unattached and held against the formwork via action of the tending gripping apparatus as hereinbefore described.

FIG. 3 is an isometric view of a tendon gripping apparatus 10 positioned against a common bearing plate 122, and thus to concrete formwork 123. The arrow 44 indicates the desired direction of rotation for the tightening nut 40 and the tensioning nut 50.

The formwork 123 shown is a typical assembly to those familiar with construction art, but the formwork may vary to accommodate the desired configuration of the final concrete structure. After the formwork panels have been assembled they are erected and aligned to conform to the desired final structure; height, width length, etc.

In use, as shown in FIG. 3, the tendon gripping apparatus 10 is slid along the longitudinal axis of the tendon 100 until it abuts the formwork via a common bearing plate 123. Then, the tightening nut 40 is manipulated so its inner end proceeds further into the barrel 20 and abuts the butt ends 35, 35 of the jaws 31, 31 forming the jaw assembly 30, proceeding further until the jaws 31, 31 radially align and then begin to narrow inward and engage the tendon 100. After the barrel 20, jaw assembly 30 and tightening nut 40 are firmly secured to the tendon 100, the tensioning nut 50 is then manipulated outward (e.g. rotated counterclockwise) to bear against the formwork 123 and, if desired, to adjust the width of the wall or channel 120 defined by the formwork 123 (see FIG. 4)

Figure 4:
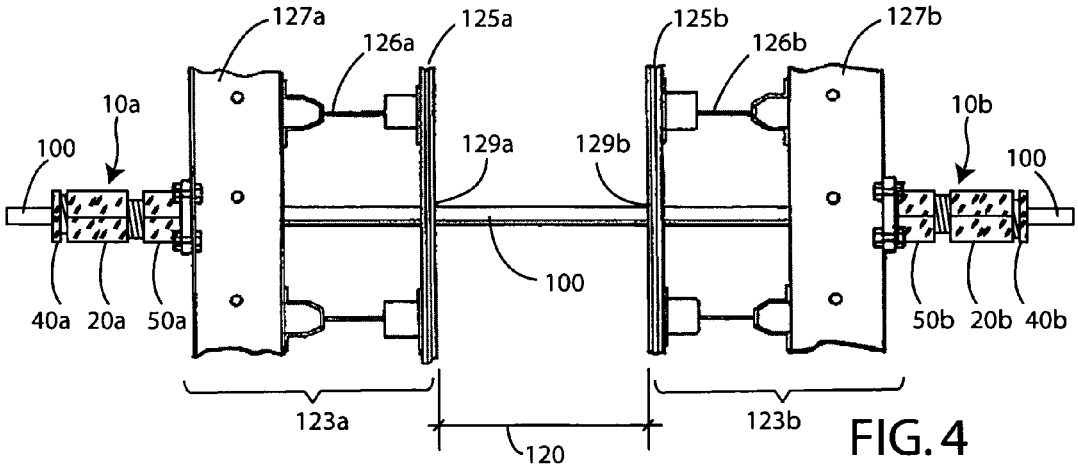
FIG. 4 is a top view of two erected, parallel form walls forming a channel into which a cementitious material is placed and cured. The view shows a tendon passing perpendicularly through the two walls, with formwork secured to the tendon and abutting the respective outwardly facing surface of both walls, the formwork being respectively secured to the tendon by tendon gripping apparatuses attached to opposing ends of the tendon.

FIG. 4 is a top view of two assembled formwork assemblies 123*a*, 123*b*. The formwork panel assemblies 123*a*, 123*b* typically consists of sheathing 125*a*, 125*b* that is supported by various types of horizontal support members 126*a*, 126*b*, and vertical support member 127*a*, 127*b*. The formwork assemblies 123*a*, 123*b* are erected parallel to one another to form a channel 120. Holes 129*a*, 129*b* are provided in the sheathing 125*a*, 125*b* so that the tendon 100 may pass through the sheathing 125*b*, 125*b*. After the formwork is assembled, the tendon 100 is passed through the formwork 123 through holes 129 drilled in the sheathing 125. A common bearing plate 122*a*, 122*b* is passed over the tendon 100. The common bearing plates 122*a*, 122*b* are called "common" because each one is a flat steel plate drilled centerline to accept the tendon. The common bearing plate 122 may be drilled at the corners for mounting to the formwork support members 126*a*, 126*b* using appropriately sized nuts, bolts and washers, or it may simply be slid over the tendon 100 to abut the support members 126*a*, 126*b* and rely on the tendon gripping apparatus 10 to secure it to the formwork 123. The tendon gripping devices 10*a*, 10*b* are slid over the tendon 100, each to one side of the formwork, thereby abutting the common bearing plates 122*a*, 122*b*. This action causes the common bearing plates 122*a*, 122*b* to be firmly placed against the support members 126*a*, 126*b*. Each tightening nut 40*a*, 40*b* is turned so that it is axially advanced toward the formwork (see FIG. 5) and into the corresponding barrel 20*a*, 20*b* so that it thereby forces the jaw assembly 30 (see item 30 of FIG. 2) forward to align radially and engage the tendon 100. Similarly, the tensioning nuts 50*a*, 50*b* are manipulated axially to press against the common bearing plates 122*a* 122*b*, thereby retaining or pushing the formwork to the desired configuration. Concrete is then placed in the channel 120.

When the concrete hardens, the formwork 123 must be removed. The tensioning nuts 50*a*, 50*b* are turned, independently, or simultaneously, such that they axially retreat from the formwork 123 and leave a space between the tendon gripping apparatus 10*a*, 10*b* and the formwork 123. At a desired time that is before, after, or while releasing the tensioning nuts 50*a*, 50*b*, the tightening nuts 40*a*, 40*b* are turned axially in a direction that causes them to retreat from the formwork 123 and the butt ends 35 of the jaw assembly's jaws 31, 31.

Figure 6:
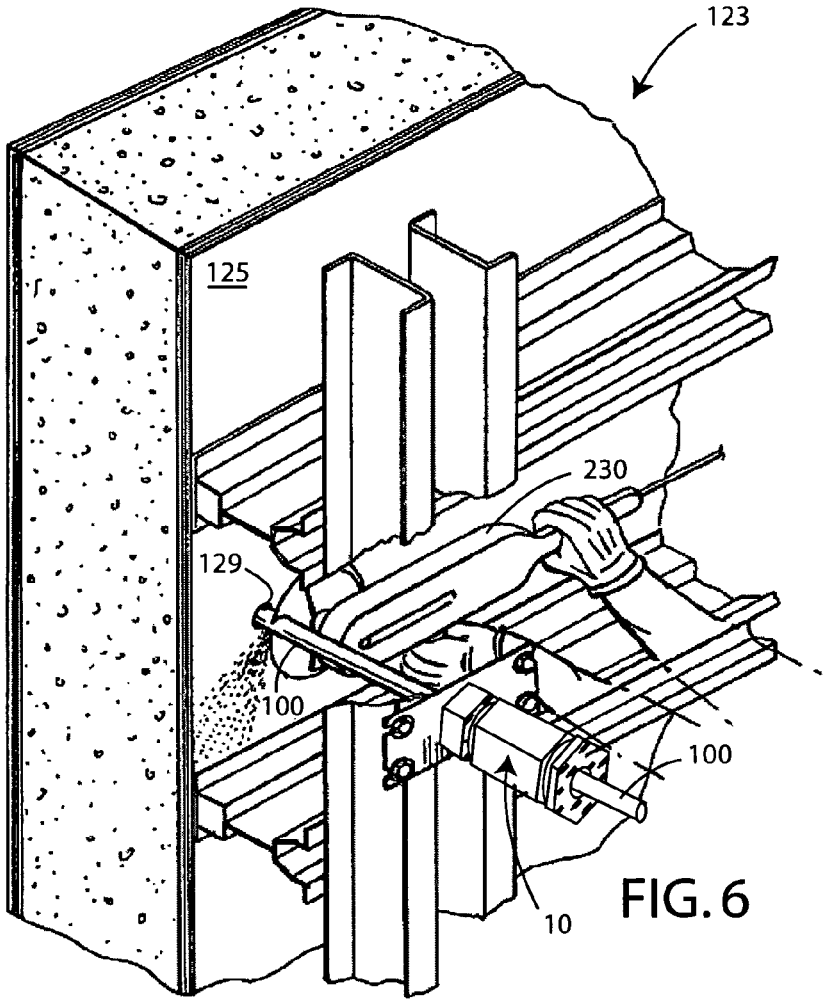
FIG. 6 is a perspective view showing how a circular saw or grinder may be used to cut a tendon after cementitious material has hardened between two parallel support walls.

The tendon gripping apparatus 10*a*, 10*b* may now be removed in a number of different manners. As shown in FIG. 6, for example, the tendon 100 may be cut at the formwork by using a grinder 230 or similar device. Alternatively, the worker may grasp the tendon gripping device 10 at the barrel 20 and, using a bending motion, force the tendon gripping device 10 perpendicular to the longitudinal axis of the tendon 100, thereby breaking the tendon. Yet another removal method is tapping the tendon gripping device 10 forward, toward the formwork, to release the jaw assembly 30 (see FIG. 2), and then removing the tendon gripping apparatus 10 by pulling the tendon gripping device 10 away from the formwork. After all of the tendons gripping devices have been removed, the formwork may then be removed and the concrete structure may enter into service.

Figure 5:
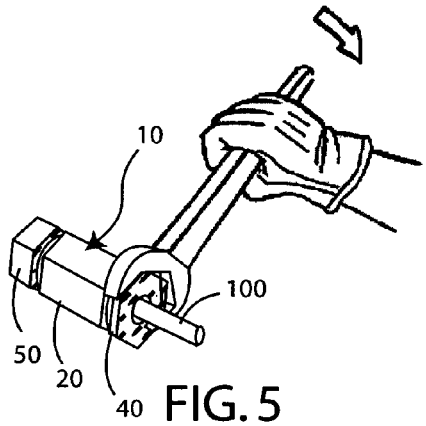
FIG. 5 is a perspective view of a tendon passing through the tendon gripping apparatus and the tendon gripping apparatus being attached to a tendon via the tightening nut.

FIG. 5 is an isometric detail showing wrench action as applied to the apparatus 10 through the tightening nut 40. Additionally, the same type of rotational element is applied to the tensioning nut 50.

FIG. 6 shows that a circular saw or grinder 230 may be used to cut the tendon 100 at the sheathing 125 in the vicinity of where the tendon 100 passes through the hole 129. Removal of the tendon gripping device 10 is described in the discussion of FIGS. 3, 4 and 5.

Figure 7:
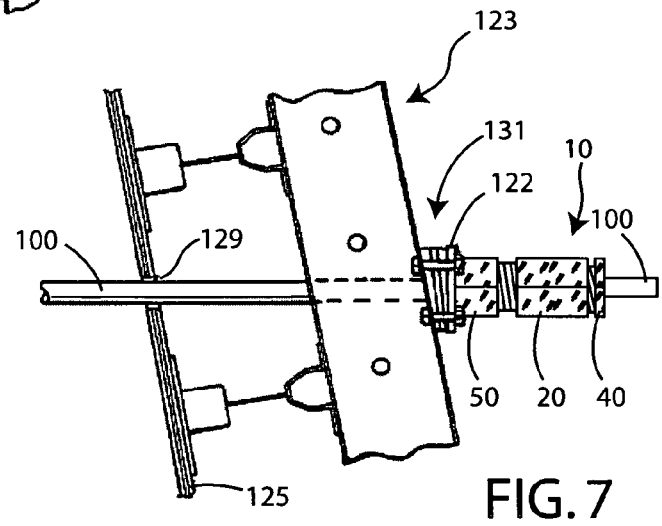
FIG. 7 is a side view of a tendon gripping apparatus that is used with formwork that is similar to that of FIG. 3, but illustrating a tendon emerging from the support wall at an angle that is not perpendicular to the support wall. The view shows tapered shims may be added between the common bearing plate and the gripper so that the plate will provide a platform for the tendon gripping device that is perpendicular to the longitudinal axis of the tendon.

FIG. 7 shows formwork 123 with sheathing 125 that does not describe a plane perpendicular to the longitudinal axis of the tendon 100. The formwork 123 is typically made of girders or beams which cannot be readily adjusted to compensate for irregularities or for mis-drilling of holes 129 in the formwork sheathing 125. Accordingly, a plurality of shimming wedges 131 may be positioned between the common bearing plate 122, to which the tendon gripping device 10 is abutted, and the formwork 123. Although not illustrated in FIG. 7, the tendon gripping apparatus 10 includes a planar abutment surface which faces and makes contact with the common bearing plate 122 or the shimming wedges 131, if used.

Figure 8A:
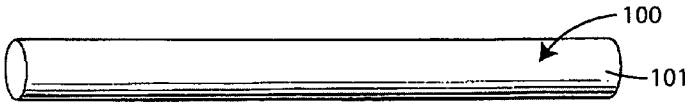
FIGS. 8A to 8C are perspective views of typical tendon configurations, FIG. 8A showing a smooth cylindrical configuration, FIG. 8B showing a cylindrical deformed configuration, and FIG. 8C showing a multiple stranded configuration.
Figure 8B:
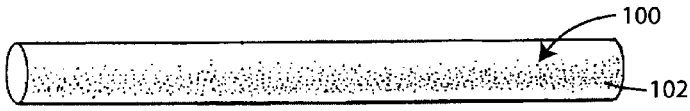
Figure 8C:
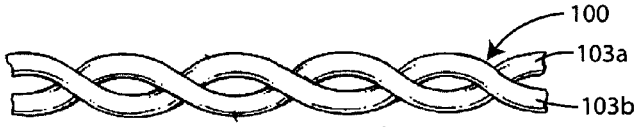

FIGS. 8A to 8C show a number of different tendon configurations. FIG. 8A is a perspective view of the tendon 100 that has a smooth surface 101. In the preferred embodiment, the tendon 100 of FIG. 8A comprises a non-metallic material which includes, among others, a fiber reinforced polymer, also known as "FRP", material. The FRP material comprises a suitable reinforced fiber and a suitable resin formed into a structural matrix wherein the type of reinforced fiber and type of resin is a function of the intended environment of use. However, the tendon 100 of FIGS. 8A, B, C may also be comprised a metallic material, such as steel. As shown in FIG. 8B, the tendon 100 may instead have a deformed surface 102, i.e. a surface that is not smooth. To achieve a deformed surface 102, the entire length of the tendon may be treated with abrasive materials, or deformations may be introduced during tendon manufacture. The deformed surface 102 increases the bonding ability between the tendon and any neighboring material such as grout or adhesive materials.

The tendon may be comprised of single strand as with FIGS. 8A, 8B or, as shown in FIG. 8C, may be formed from multiple strands 103*a*, 103*b* intertwined in a helical orientation to form a single tendon. Though FIG. 8C illustrates only two strands, it is to be expressly understood that a single tendon may comprise two or more strands.

Figure 8D:
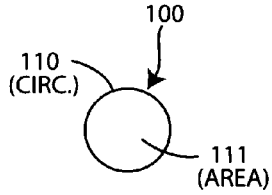
FIG. 8D is a cross-sectional view of a typical tendon which draws attention to its circumference and its area.

FIG. 8D is a cross-sectional display of a singled stranded tendon 100 shown in FIG. 8A or 8B, or of a single strand of a multiple stranded tendon shown in FIG. 8C. Item number 110 identifies the circumference of the cylindrical tendon 100, or strand 103*a* of multiple strand tendon and Item number 111 defines the tendon area or cross-sectional area.

Figure 9A:
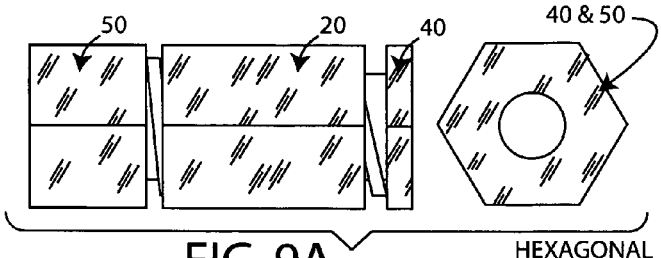
FIGS. 9A to 9C are perspective views of different external configurations for a tendon gripping device that serve as examples of the many possible configurations.
Figure 9B:
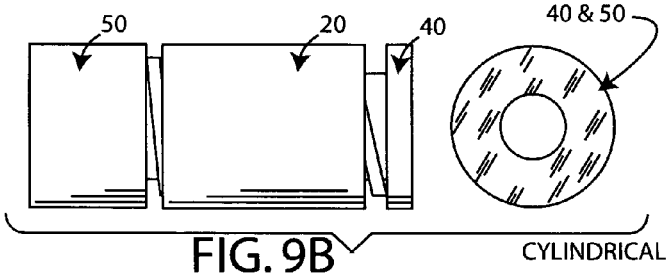
Figure 9C:
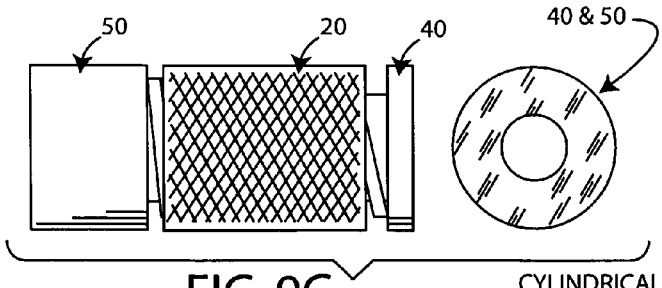

FIGS. 9A to 9C show a number of different configuration for a tendon gripping apparatus 10 formed from a barrel 20, a tightening nut 40, and a tensioning nut 50. FIG. 9A illustrates the preferred configuration, to wit, a hexagonal geometry for the barrel 20, the tightening nut 40, and the tensioning nut 50. FIG. 9B, by contrast, illustrates a cylindrical geometry for the barrel 20, the tightening nut 40, and the tensioning nut 50. FIG. 9C, lastly, illustrates a cylindrical geometry for the barrel 20, the tightening nut 40, and the tensioning nut 50, but here the barrel 20 has a knurled surface 25. The illustrated geometries are exemplary in nature as there are many different possibilities. Moreover, all of the illustrated and other possible geometries may be combined or even interchanged with one another, i.e., all of the components may be knurled, or a knurled barrel 20 may be used with hexagonal nuts 40, 50, etc.

Figure 10A:
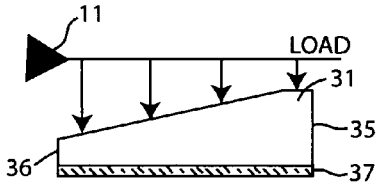
FIGS. 10A and 10B are side views of two different jaw configurations that illustrate load distribution to the jaws, and thus to the tendon, following load transfer from the source through the jaw of the tendon gripping apparatus.
Figure 10B:
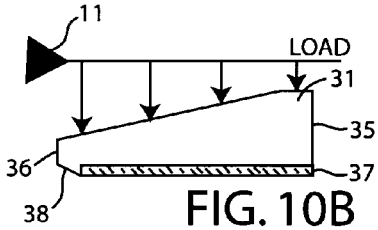

FIG. 10 illustrates one jaw 35 from the jaw assembly 30 shown in FIG. 2, and shows how the load distribution 11 (see FIG. 1) is transferred to the jaw 31, evenly over the surface of the jaw 31, from the planar surface of the tensioning nut 50, to the barrel 20 via the taper 17 that is in the shape of a truncated cone. As best seen in FIG. 2, the incident angle 28*a* of the conical taper 17 in the barrel 20 and the incident angle 28*b* of the jaw 31 are complementary. The jaws 31 are positioned radially, and engaged with the tendon 100, by manipulating the tightening nut 40 in the preferred clockwise motion as hereinbefore described. FIG. 10A shows a jaw 31 of current usage. FIG. 10B shows a jaw 31 used in the instant, novel tendon gripping apparatus 10 which uniquely includes the relief 38 located at the jaw's nose 36. As noted above in the "Field of the Invention", " . . . the configuration of current tendon gripping apparatus limits this ultimate tendon tensile strength at failure is attributable to the nose of the jaws (wedges) biting into the with continuing vigor until tendon (rod) tensile occurs." and describes the first and main contributory parameter in tendon failure. It is desirable to have the load 11 quickly and totally transferred from the surface of the tendon 100 to the entire cross-sectional area of the tendon 100. It can be readily seen that tendon material strengths lie in utilizing the entire, or as close to entire tendon area strength capability. The action of transfer is termed mechanical efficiency and is expressed in percentages. As an example, if a tendon has a total load bearing capacity of 1000 pounds as calculated from tendon component strengths and verified by such standard testing procedures as is described above in the "Field of the Invention" section, and if it fails at 1000 pounds, then the tendon gripping apparatus has a mechanical efficiency of 100%. Tendon failure at less than the total load capacity would result in a mechanical efficiency of less than 100% depending on the load at which it fails. The entire load 11 is ultimately borne by the tendon 100.

In all cases with a tendon gripping apparatus as defined herein, the tapered jaws 31 of the jaw assembly 30 move in the tapered cavity 27 of the barrel 20 upon application of the tightening procedure hereinbefore described, and upon application of the load 11. The movement of the jaw assembly 30 is parallel but opposite in direction to the load 11, following Newtonian Laws.

Looking at FIG. 10A, upon application of the load 11, the nose 36 will immediately begin biting into the tendon 100 (not shown).

Looking at FIG. 10B, upon application of the load 11, the action of the relief 38 allows the main portion of the jaw 31 contact area to engage the tendon 100 prior to the nose 36 coming into contact with the tendon 100. This permits better transfer of the load 11 from the tendon 100 surface to the entire cross-sectional area 111 of the tendon 100 (see FIG. 8D). The mechanical efficiency of the jaw 4 configuration shown in FIG. 10B has been shown to be significantly greater than that shown in FIG. 10A.

Figure 10C:
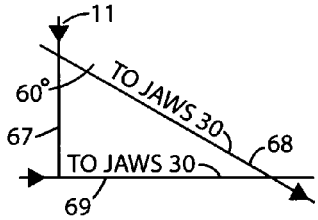
FIG. 10C is a vector analysis representation of the load distribution at the jaw assembly 30 taking into the account the effect of the relief angle 38.

FIG. 10C is a mathematical expression of the load distribution at the jaw assembly 30 taking into the account the effect of the relief angle 38 using a vector analysis. Vector 67 represents the entire load 11. Vectors 68 and 69 represent components of vector 67 distributing the entire load 67 from the jaw nose 36 to the main jaw component 31. The load distribution to the nose end 36 of the threaded portion 37 of FIG. 10B is expressed as the cosine of the relief angle 38 shown (60 degrees). Taking the previously noted load of 1000 pounds with 100% mechanical efficiency of the tendon gripping apparatus; tensioning nut 50, to barrel 20, to barrel taper 27 to jaws 30, the load at the nose 36 is 500 pounds.

In FIG. 10A, absent the relief component 38, the load at the nose end 36 of the jaw is linear and equal to the entire load on the jaws 30. Again, in taking the 1000 pounds previously noted, this load would be 1000 pounds It may be seen in FIGS. 10B and 10C that with a load significantly lower at the nose 36, load is transferred more efficiently, and to a greater extent to the tendon 100. This load transfer occurs prior to the nose movement with tapered cavity 27 of the barrel 20, thereby encouraging nose engagement of the tendon 100.

Looking at an application whereby jaws 30 as depicted in 10A are sufficient for the load, it may be seen that by replacing the jaws of FIG. 10A with the jaws of FIG. 10B, then either the jaws or tendon may be reduced in size.

FIGS. 11A to 11F are sectional side views illustrating the structure of the instant tendon gripping device 10 in an internal embankment stabilization application. FIG. 11A shows an embankment 241 of natural substrate 242 having a substantially vertical face 243. FIG. 11B shows a hole 244 that has been formed in the embankment 241 by drilling through the vertical face 243 of the embankment. The hole 244 has substantial depth. In FIG. 11C, a tendon 100 is inserted into the hole 244. The tendon 100 has a length greater than the depth of the hole 244 such that a portion 101 of the tendon 100 extends out of the hole 244 as shown in FIG. 11C. In FIG. 11D, the hole 244 is filled with grout 247. The grout 247 comprises a cementitious material. The tendon 100 may be smooth or deformed as hereinbefore described (see FIG. 7).

FIG. 11E illustrates application of a tendon gripping device FIG. 1 to the tendon 100 on to a near vertical surface, abutting against a common bearing plate 222, see FIG. 6. The common bearing plate 222 abuts a temporary retaining structure formed of concrete as hereinbefore described, or such other temporary structure used until final embankment stabilization occurs. FIG. 11F illustrates a finished installation with permanent retaining structure in place. Load transfer is as hereinbefore described.

Although the invention has been discussed with reference to specific embodiments, it will be apparent that the concept can be otherwise embodied to achieve the advantages discussed.

The invention claimed is:

1. A tendon gripping combination comprising:

concrete formwork used to form a concrete structure through placement of cementitious materials within the concrete formwork, the concrete formwork comprising sheathing having a hole therein and a smooth, deformed or multiple stranded tendon extending through the hole in the sheathing; and a tendon gripping apparatus for gripping the tendon extending through the hole in the sheathing and preventing the sheathing from sliding along the tendon toward the tendon gripping apparatus, the tendon gripping apparatus comprising:

a housing with a tapered inner wall defining a chamber within the housing, the chamber being accessible on opposing ends of the housing through a front aperture and a rear aperture, the tapered inner wall defining the chamber such that the chamber increasingly narrows toward a front portion of the chamber adjoining the front aperture and to one of the opposing ends of the housing, the front aperture being a cylindrical bore with threads formed from a helical thread on the exterior of the housing, and such that the chamber increasingly widens toward a back portion of the chamber adjoining the rear aperture, the rear aperture being a cylindrical bore with a helical thread on the interior of the housing, the front aperture, the chamber, and the rear aperture being sized to permit passage of the tendon through the housing, the helical threads associated with the housing's front and rear apertures having front and rear thread diameters;

a jaw cluster positioned within the chamber and sized such that the tendon may freely enter the front aperture and exit the chamber through a rear aperture, the jaw cluster comprising a plurality of elongated jaw members for securing the tendon within the apparatus, each jaw member comprising a rear portion, a nose portion, a tapered outer surface facing the tapered inner wall, and a clasping inner surface facing the tendon, the nose portion of each jaw member further comprising an un-threaded inward facing relief that defines a larger remaining area of the clasping inner surface behind the un-threaded inward facing relief, the un-threaded inward facing relief functioning to transfer load forces to the larger remaining area of the clasping inner surface located behind the un-threaded inward facing relief upon application of a full load to the tendon gripping apparatus;

a tightening nut having a cylindrical conduit therethrough having a conduit diameter larger than a diameter of the tendon, the cylindrical conduit leading to a rear aperture of a diameter larger than the tendon diameter whereby the tendon may pass through the apparatus and out the rear aperture of the tightening nut, the tightening nut further comprising:

a mechanical interface for being twisted;

a front pushing surface directly contacting and pushing against the rear portion of the jaw cluster;

an intermediate threaded portion having a helical thread carried circumferentially thereabout to permit threading of the tightening nut into the helical thread on the interior and at the rear of the housing, the tightening nut's helical thread having a thread diameter that matches the housing's rear thread diameter;

wherein the tightening nut advances into the housing in response to a twisting force applied to the mechanical interface, the twisting force initiating a direct pushing contact between the front pushing surface of the tightening nut and the rear portion of the jaw cluster, the pushing contact advancing the jaw cluster toward the front portion of the housing and thereby securing the tendon within the apparatus between the clasping inner surface of the elongated jaw members forming the jaw cluster when the tapered outer surfaces of the elongated jaw members forming the jaw cluster contact the tapered inner wall of the housing; and wherein the tightening nut withdraws from the housing in response to a counter-twisting force applied to the mechanical interface; and a tensioning nut having a cylindrical conduit therethrough having a conduit diameter larger than the tendon diameter, the cylindrical conduit leading to a front aperture of a diameter larger than the tendon diameter whereby the tendon may pass through the front aperture and into the cylindrical conduit of the tensioning nut and further in to the apparatus, the tensioning nut further comprising:

a mechanical interface for being twisted;

a front planar abutment surface for abutting and pushing against the concrete formwork; and an intermediate threaded portion having a helical thread carried circumferentially thereabout to permit threading of the tensioning nut onto the helical thread located on the exterior and at the front of the housing, the tensioning nut's helical thread having a thread diameter that matches the housing's front thread diameter;

wherein the tensioning nut advances forward away from the remainder of the apparatus in response to a twisting force applied to the mechanical interface, the twisting force initiating a pushing contact between the front planar abutment surface of the tensioning nut that contacts the concrete formwork and thereby adjusting the concrete formwork to a desired position.

2. The tendon gripping combination of claim 1 wherein the tightening nut and the tensioning nut are detachable from the housing.

3. The tendon gripping combination of claim 1 wherein the mechanical interfaces of the tightening nut and the tensioning nut comprise a hexagonal configuration for being torqued by a tool.

4. The tendon gripping combination of claim 3 wherein the housing includes an exterior surface that also has a hexagonal configuration.

5. The tendon gripping combination of claim 1 wherein the mechanical interfaces of the tightening nut and the tensioning nut comprise a smooth cylindrical configuration.

6. The tendon gripping combination of claim 5 wherein the housing includes an exterior surface that also has a smooth cylindrical configuration.

7. The tendon gripping combination of claim 1 wherein the housing is cylindrical and knurled, and wherein the tightening and tensioning nuts have a smooth cylindrical configuration.

8. The tendon gripping combination of claim 1 wherein the tapered inner wall defines a chamber within the housing that is conical in shape.

9. The tendon gripping combination of claim 1 further comprising a plurality of shimming wedges making contact with and positioned between the front planar abutment surface and the concrete formwork.

10. The tendon gripping combination of claim 1 wherein the plurality of elongated jaw members comprise two elongated jaws members.

11. The tendon gripping combination of claim 1 wherein the plurality of elongated jaw members are approximately equal in size.

12. The tendon gripping combination of claim 1 wherein the helical threads of the housing, tightening nut and tensioning nut comprise speed threads having less than 8 threads per inch relative to a thread diameter of one inch.

13. The tendon gripping combination of claim 1 wherein the helical threads of the housing, tightening nut and tensioning nut comprise speed threads having about 5 threads per inch relative to a thread diameter of one inch.

* * * * *